US007120428B2

(12) United States Patent
Higgs

(10) Patent No.: US 7,120,428 B2
(45) Date of Patent: Oct. 10, 2006

(54) REMOTE LOCOMOTIVE CONTROL

(75) Inventor: David B. Higgs, Bradford, PA (US)

(73) Assignee: Control Chief Corporation, Bradford, PA (US)

( * ) Notice: Subject to any disclaimer, the term of this patent is extended or adjusted under 35 U.S.C. 154(b) by 490 days.

(21) Appl. No.: 10/222,376

(22) Filed: Aug. 16, 2002

(65) Prior Publication Data

US 2003/0036368 A1 Feb. 20, 2003

Related U.S. Application Data

(60) Provisional application No. 60/313,372, filed on Aug. 17, 2001.

(51) Int. Cl.

| | |
|---|---|
| ***H04M 3/00*** | (2006.01) |
| ***G05D 3/00*** | (2006.01) |
| ***G06F 17/00*** | (2006.01) |
| ***B60R 25/10*** | (2006.01) |

(52) U.S. Cl. ..... 455/418; 455/420; 455/41.2; 701/2; 701/19; 701/20; 340/426.13

(58) Field of Classification Search ..... 455/418, 455/419–420, 41.1, 41.2, 68, 70, 411; 702/2, 702/19, 20, 36, 41; 246/187 A; 340/426.13, 340/931, 906

See application file for complete search history.

(56) References Cited

U.S. PATENT DOCUMENTS

| | | | | |
|---|---|---|---|---|
| 3,664,046 A * | 5/1972 | Thompson | 38/143 |
| 4,217,643 A | 8/1980 | Anderson et al. | 364/426 |
| 4,230,992 A * | 10/1980 | Munkberg | 327/44 |
| 4,687,258 A | 8/1987 | Astley | 303/3 |
| 5,511,749 A | 4/1996 | Horst et al. | 246/187 A |
| 5,685,507 A | 11/1997 | Horst et al. | 246/187 A |
| 6,789,004 B1 * | 9/2004 | Brousseau et al. | 701/19 |
| 6,837,466 B1 * | 1/2005 | Peltz | 246/187 A |
| 6,854,691 B1 * | 2/2005 | Kraeling et al. | 246/2 F |

OTHER PUBLICATIONS

Locomotive Control System LSC—Beltpack CN Rail; Sep. 1991; pp. 1-15.

BNSF General Code Of Operating Rules; Oct. 10, 1999; pp. 1-23.

* cited by examiner

*Primary Examiner*—Duc M. Nguyen
(74) *Attorney, Agent, or Firm*—The Webb Law Firm

(57) ABSTRACT

A remote locomotive control system includes a slave controller configured to receive data strings from remote transmitters. The slave controller is responsive to an acquire signal received from one of the remote transmitters for configuring the slave controller to control one or more control functions of the locomotive as a function of one or more data strings received exclusively from the one remote transmitter. However, the slave controller is configured so that any remote transmitter can control safety functions of the locomotive via the slave controller.

12 Claims, 2 Drawing Sheets

REMOTE LOCOMOTIVE CONTROL

CROSS REFERENCE TO RELATED APPLICATION

This application claims priority from U.S. Provisional Patent Application Ser. No. 60/313,372, filed Aug. 17, 2001, entitled "Remote Locomotive Control".

BACKGROUND OF THE INVENTION

1. Field of the Invention

The present invention relates to an electronic system for remotely controlling a locomotive.

2. Description of Related Art

In switching yards, it is desirable to have one or more ground-based operators controlling the movement of a locomotive. This is typically accomplished by each ground-based operator having a radio transmitter that communicates with a slave controller located on board the locomotive via a radio link. Typically, the operator carries the transmitter and manipulates knobs, buttons, switches, and the like to control corresponding functions on the locomotive via the slave controller and the radio link therewith.

It is often desirable in switching yards to have a ground-based operator positioned at each end of a consist, with each operator having a radio transmitter. The transmitters are configured so that both transmitters can cause the execution of safety functions of the locomotive but only one transmitter at a time controls control functions of the locomotive. To this end, depending on the movement of the consist, it is desirable for each transmitter to selectively assume exclusive control of the control functions of the locomotive while preserving the ability of both transmitters to, at all times, control safety functions of the locomotive.

It is, therefore, an object of the present invention to provide a remote locomotive control system that includes two or more transmitters in radio communication with a slave controller located on board a locomotive for controlling control and safety functions thereof. The system is configured so that only one transmitter at a time can assume exclusive control of the control functions of the locomotive while at all times all of the transmitters can control safety functions of the locomotive. The system is configured to enable control of the control functions of the locomotive to be assumed by any of the transmitters on a first-come first-served basis when no transmitter is currently controlling the control functions of the locomotive. Moreover, the system is configured so that a user of each transmitter can relinquish control of the locomotive when desired. Still other objects of the invention will be apparent to those of ordinary skill in the art upon reading and understanding the following detailed description.

SUMMARY OF THE INVENTION

The invention is a remote locomotive control system that includes a slave controller configured to receive data strings from a plurality of remote transmitters. The slave controller is responsive to an acquire signal received from one of the remote transmitters for configuring the slave controller to control one or more control functions of the locomotive as a function of one or more data strings received exclusively from said one remote transmitter. The slave controller, however, is responsive to data strings received from any of the plurality of remote transmitters for controlling one or more safety functions of the locomotive as a function thereof.

The invention is also a remote locomotive control method that includes providing a first transmitter, a second transmitter and a slave controller. A first data string is received by the slave controller from the first transmitter. The first data string includes the first acquire bit in a first binary state and one or more control function bits related to one or more control functions of the locomotive. In response to receiving the first data string, the slave controller controls one or more control functions of the locomotive as a function of the one or more control function bits of the first data string. A second data string can be received by the slave controller from the first transmitter. The second data string includes the first acquire bit in its second binary state and the one or more control function bits. In response to receiving the second data string, the slave controller terminates controlling the one or more control functions of the locomotive as a function of the one or more control function bits of the second data string.

If the slave controller receives from the second transmitter a data string that includes a second acquire bit in a first binary state and one or more control function bits related to control functions of the locomotive at a time before it receives the first acquire bit in its second binary state, the slave controller withholds controlling one or more control functions of the locomotive as a function of the one or more control function bits of the data string received from the second transmitter.

The first and second data strings can each include one or more safety function bits related to safety functions of the locomotive. The slave controller can control one or more safety functions of the locomotive as a function of the one or more safety function bits of at least one of the first and second data strings regardless of the receipt or state of each acquire bit included in a data string received by the slave controller.

Lastly, the invention is a remote locomotive control system that includes a first transmitter configured for radio transmitting a first data address and first acquire data and a second transmitter configured for radio transmitting a second data address and second acquire data. The first and second transmitters are also configured for radio transmitting control data regarding control functions of the locomotive and safety data related to safety functions of the locomotive. A slave controller is provided for radio receiving the data addresses, the acquire data, the control data and the safety data from the first and second transmitters. The slave controller is responsive to the first acquire data received from the first transmitter for controlling control functions of the locomotive as a function of control data received from the first transmitter and for blocking control of control functions of the locomotive as a function of control data received from the second transmitter. The slave controller is also responsive to safety data received from one or both of the first and second transmitters for controlling safety functions of the locomotive.

DETAILED DESCRIPTION OF THE INVENTION

Figure 1A:
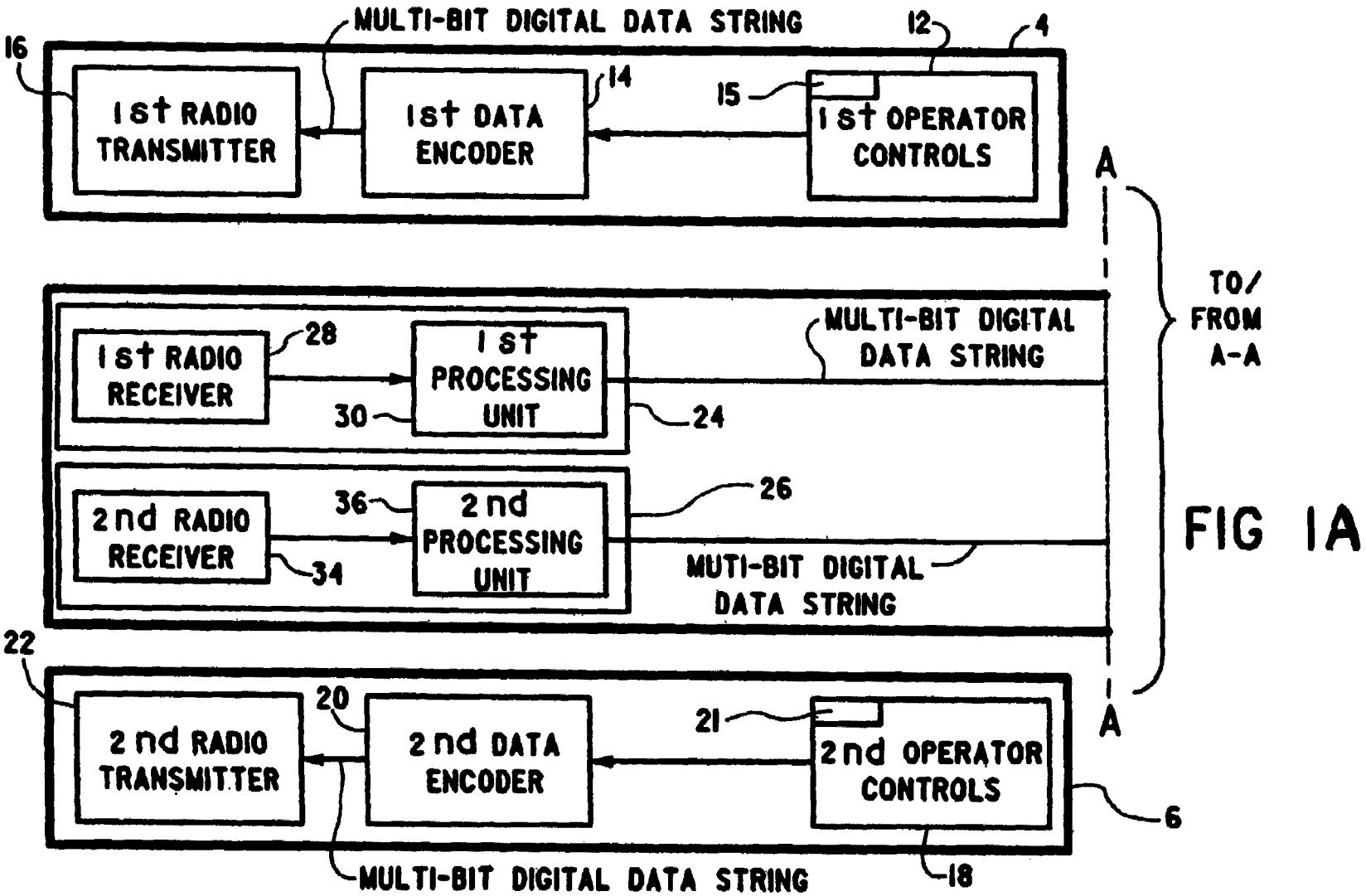
FIG. 1 is a block diagram of a remote locomotive control system in accordance with the present invention.
Figure 1B:
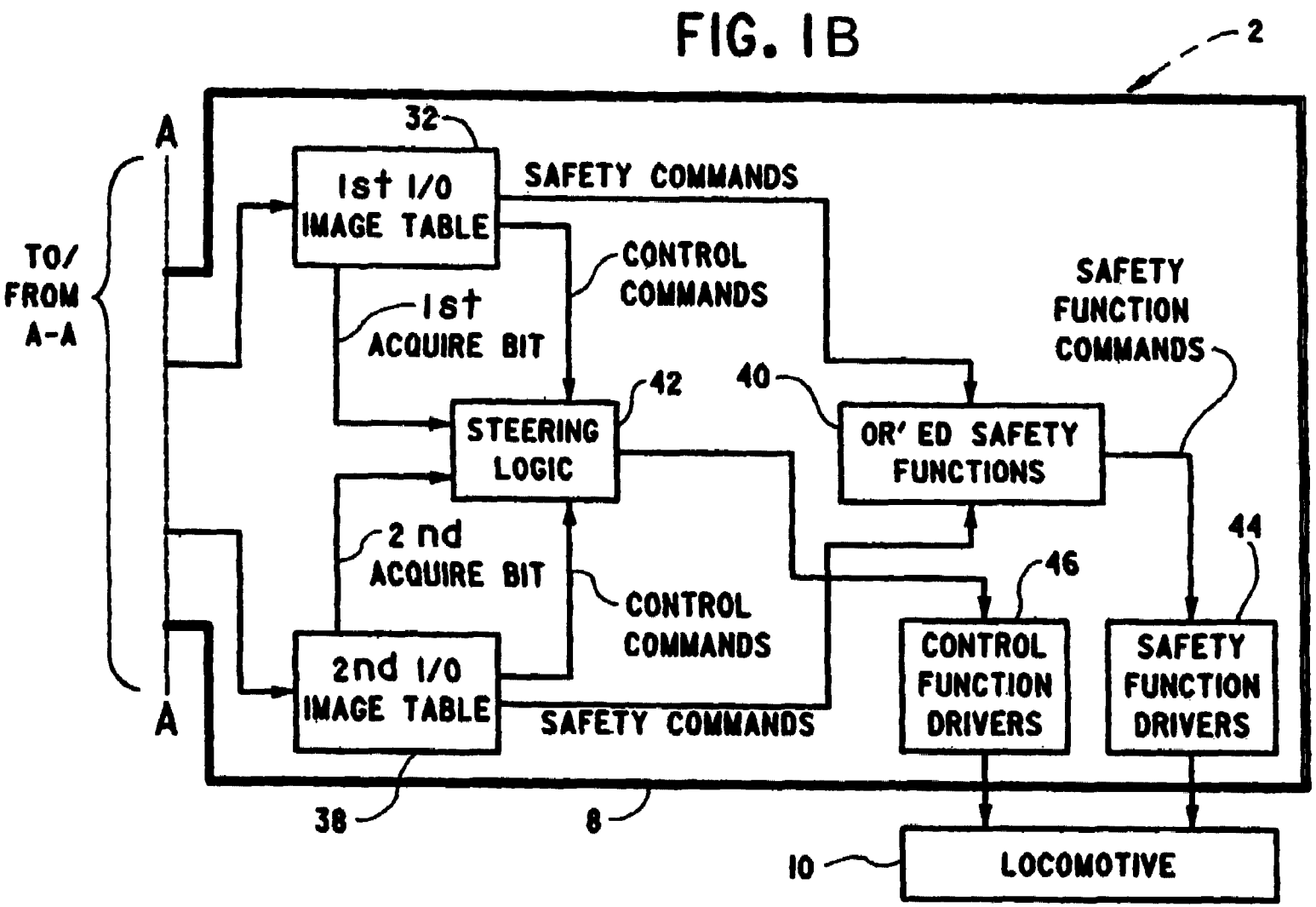

A remote locomotive control system 2 includes a first remote transmitter 4, a second remote transmitter 6 and a slave controller 8 located on board a locomotive 10. First transmitter 4 includes first operator controls 12 which includes control means, such as knobs, buttons, switches and the like (not shown), which mirror certain operator controls (not shown) on locomotive 10. In response to user activation of one or more control means thereof, first operator controls 12 outputs one or more control signals related to one or more functions of locomotive 10 to a first data encoder 14. These control signals can include analog control signals, digital control signals and combinations thereof. First data encoder 14 converts these one or more control signals into a multi-bit digital data string that is output to a first radio transmitter 16 for modulation onto a radio frequency signal which is transmitted to slave controller 8. The multi-bit digital data string includes one or more bits for each function of locomotive 10 to be controlled by first operator controls 12. These functions include safety functions of locomotive 10 and control functions of locomotive 10. Non-limiting examples of safety functions include emergency shut down, tilt/man down, horn and bell. Non-limiting examples of control functions include speed select, direction and brake level.

Second transmitter 6 includes second operator controls 18, second data encoder 20 and second radio transmitter 22 which operate in the same manner as first operator controls 12, first data encoder 14 and first radio transmitter 16 of first transmitter 4. First operator controls 12 and second operator controls 18 each include input means 15 and 21, respectively, for enabling users of first transmitter 4 and second transmitter 6 to input a data address of a first receiver 24 and a data address of a second receiver 26, respectively, of slave controller 8. The data addresses of first receiver 24 and second receiver 26 are included in the multi-bit digital data strings output by first data encoder 14 and second data encoder 20.

First receiver 24 includes a first radio receiver 28 for receiving radio frequency signals from first transmitter 4. First radio receiver 28 demodulates the multi-bit digital data string from each received radio frequency signal received from first transmitter 4 and outputs this multi-bit digital data string to a first processing unit 30 which is programmed with the data address of first receiver 24. First processing unit 30 compares this programmed data address to the data address included in the multi-bit digital data string. If these data addresses do not match, first processing unit 30 blocks or withholds the passage of the remaining bits, i.e., the bits related to functions of locomotive 10 and an acquire bit (discussed hereinafter), of the multi-bit digital data string to a first I/O image table 32. However, if the data addresses match, first processing unit 30 passes the remaining bits of the multi-bit digital data string to first I/O image table 32. Second receiver 26 includes a second radio receiver 34 and a second processing unit 36 which operate in the same manner as first radio receiver 28 and first processing unit 30. Second processing unit 36, however, is programmed with the data address of second receiver 26. Second processing unit 36 compares this program data address to the data address included in a multi-bit digital data string received from second radio receiver 34. If the data addresses match, second processing unit 36 passes the remaining bits of the multi-bit digital data string to a second I/O image table 38. However, if these data addresses do not match, second processing unit 36 blocks or withholds the passage of the remaining bids of the multi-bit digital data string to second I/O image table 38. To avoid first and second receivers 24 and 26 from receiving radio frequency signals from second and first transmitters 6 and 4, respectively, first receiver 24 and first transmitter 4 are configured to operate on a first radio frequency and second receiver 26 and second transmitter 6 are configured to operate on a second, different radio frequency.

The part of the multi-bit digital data string output by first data encoder 14 includes a first acquire bit that is set in its first binary state when an operator of first transmitter 4 desires to assume remote control of the control functions of locomotive 10 and which is set in its second binary state when the operator of first transmitter 4 desires to relinquish control of the control functions of locomotive 10. Similarly, the portion of the multi-bit digital data string output by second data encoder 20 includes a second acquire bit which is set in its first binary state when the operator of second transmitter 6 desires to assume remote control of the control functions of locomotive 10 and which is set in its second binary state when the operator of second transmitter 6 desires to relinquish control of the control functions of locomotive 10. The states of the first and second acquire bits can be set at first operator controls 12 and second operator controls 18 by users of first transmitter 4 and second transmitter 6, respectively.

The multi-bit digital data strings output by first processing unit 30 and second processing unit 36 to first I/O image table 32 and second I/O image table 38 include the first acquire bit and the second acquire bit, respectively.

First I/O image table 32 separates the bits of the multi-bit digital data string received from first processing unit 30 into those related to safety commands for controlling safety functions, control commands for controlling control functions and the first acquire bit. First I/O image table 32 then outputs the bits related to the safety commands to an OR'ed safety functions block 40 and outputs the bits related to the control commands and the first acquire bit to a steering logic block 42. In a similar manner, second I/O image table 38 separates bits of the multi-bit digital data string received from second processing unit 36 into those related to the safety commands for controlling safety functions, control commands for controlling control functions and the second acquire bit. Second I/O image table 38 then outputs the bits related to the safety commands to OR'ed safety functions block 40 and outputs the bits related to the control commands and the second acquire bit to steering logic block 42. For simplicity of description hereinafter, the phrase "safety commands" will be utilized to refer to the bits related to the safety commands and the phrase "control commands" will be utilized to refer to the bits related to the control commands.

OR'ed safety functions block 40 logically ORs corresponding safety commands received from first I/O image table 32 and second I/O image table 38 to produce for each set of corresponding safety commands a related safety function command. For example, a bell safety command from I/O image table 32 is logically OR'ed with a bell safety command from second I/O image table 38 to produce a bell safety function command. OR'ed safety functions block 40 outputs the safety function commands to a safety function drivers block 44 which causes the safety function hardware of locomotive 10 associated with each safety function command to be activated or deactivated as a function of the corresponding safety function command received by safety function drivers block 44. For example, if the bell safety function command is set to a state requesting activation of the bell of locomotive 10, safety function drivers block 44 receives this command and causes the bell of locomotive 10 to ring. In contrast, if the bell safety function command is not requesting activation of the bell, safety function drivers block 44 does not cause the bell of locomotive 10 to ring.

Steering logic block 42 implements a first-come first-served logic based upon which acquire bit in its first state is first received by steering logic block 42. For example, starting from a quiescent state where neither the first acquire bit nor the second acquire bit is set to its first state, if steering logic block 42 receives the first acquire bit in its first binary state from first I/O image table 32, steering logic block 42 passes the control commands received from first I/O image 32 to a control functions driver block 46 and, at the same time, blocks the passage of any control commands output by second I/O image table 38. If steering logic block 42 receives from second I/O image table 38 control commands and the second acquire bit set to its first binary state, indicative of second transmitter 6 desiring to take control of locomotive 10, at a time when the first acquire bit is already set to its first binary state, steering logic block 42 ignores the second acquire bit and blocks the passage of control commands received from second I/O image table 38.

When a user of first transmitter 4 desires to relinquish control of locomotive 10, the user of first transmitter 4 causes first operator controls 12 to output the first acquire bit in its second binary state. In response to receiving the first acquire bit in its second binary state, steering logic block 42 terminates or commences blocking the passage of control commands from first I/O image table 32.

When the first acquire bit is set to its second binary state, whereupon a user of first transmitter 4 relinquishes control of locomotive 10, a user of second transmitter 6 can cause the second acquire bit to be set to its first binary state whereupon the user of second transmitter 6 can assume control of locomotive 10. More specifically, when the second acquire bit is set to its first binary state at a time when the first acquire bit is set to its second binary state, steering logic block 42 passes control commands received from second I/O image table 38 to control function drivers block 46 and, at the same time, blocks the passage of control commands received from first I/O image table 32. If the first acquire bit is set to its first binary state at a time when the second acquire bit is already in its first binary state, steering logic block 42 ignores the first acquire bit and blocks the passage of control commands from first I/O image table 32.

When the user of second transmitter 6 desires to relinquish control of locomotive 10, the user of transmitter 6 causes second operator controls 18 to output the second acquire bit in its second binary state. In response to receiving the second acquire bit in its second binary state, steering logic block 42 terminates or commences blocking the passage of control commands received from second I/O image table 38.

Each control command received by control function drivers block 46 causes control function drivers block 46 to control suitable hardware of locomotive 10 in a manner consistent with the control command. For example, if the control command received by control function drivers block 46 requests the partial application of the brakes of locomotive 10, control function drivers block 46 will cause the partial application of the brakes of locomotive 10 in response to receiving this control command from steering logic block 42.

As can be seen, the first and second acquire bits in combination with steering logic block 42 enable a user of first transmitter 4 or second transmitter 6 to assume exclusive control of the control functions of locomotive 10 when the user of the other of first transmitter 4 and second transmitter 6 is not in control of the control functions of locomotive 10. In addition, a user of first transmitter 4 or second transmitter 6 in control of locomotive 10 can relinquish exclusive control of locomotive 10 by changing the state of the acquire bit associated with first transmitter 4 or second transmitter 6. When neither acquire bit is set to a state indicative of first or second transmitter 4 or 6 desiring to take control of locomotive 10, slave controller 8 is in a quiescent state whereupon a user of first transmitter 4 or a user of second transmitter 6 can assume control of locomotive 10 on a first-come first-served basis by causing the first acquire bit or the second acquire bit in its first state to be first received by steering logic block 42.

In addition, the first and second I/O image tables 32 and 38 in combination with OR'ed safety functions block 40 enable a user of first transmitter 4 and/or a user of second transmitter 6 to either individually or simultaneously exercise control of safety functions of locomotive 10 regardless of whether first transmitter 4 or second transmitter 6 has exclusive control of the control functions of locomotive 10. For example, if a user of first transmitter 4 has assumed exclusive control of the control functions of locomotive 10, the user of second transmitter 6 can control any of the safety functions of locomotive 10 via second transmitter 6.

The invention has been described with reference to the preferred embodiment. Obvious modifications and alterations will occur to others upon reading and understanding the preceding description. For example, while the foregoing embodiment was described in connection with a pair of remote transmitters 4 and 6, a pair of receivers 24 and 26 and a pair of I/O image tables 32 and 38, it is envisioned that the remote locomotive control system 2 can be scaled to include additional remote transmitters, receivers and I/O image tables as desired. It is, therefore, intended that the invention be construed as including all such modifications and alterations insofar as they come within the scope of the appended claims or the equivalents thereof.

The invention is claimed to be:

1. A remote locomotive control system comprising a slave controller configured to receive data strings from a plurality of remote transmitters, the slave controller responsive exclusively to an acquire signal received from one of the remote transmitters for configuring the slave controller to control one or more control functions of the locomotive as a function of one or more data strings received exclusively from said one remote transmitter, wherein:

each data string includes one or more bits related to one or more safety functions of the locomotive, one or more bits related to one or more control functions of the locomotive and one or more bits related to the acquire signal;

the acquire signal is an acquire bit;

from a quiescent state where the slave controller is not responsive to the one or more bits related to the one or more control functions of the locomotive, in response to receiving from a first remote transmitter the acquire bit thereof in a first binary state, the slave controller commences controlling the one or more control functions of the locomotive as a function of the receipt by the slave controller from the first remote transmitter of the one or more bits related thereto; and in response to receiving from the first remote transmitter the acquire bit thereof in a second binary state, the slave controller returns to its quiescent state.

2. The system as set forth in claim 1, wherein the slave controller is responsive to data strings received from any of the plurality of remote transmitters for controlling one or more safety functions of the locomotive as a function thereof.

3. The system as set forth in claim 2, wherein each remote transmitter is responsive to an operator control thereof for transmitting one of said data strings to the slave controller.

4. The system as set forth in claim 1 wherein, between the time the slave controller receives from the first remote transmitter the acquire bit thereof in its first and second binary states, the slave controller is not responsive to the receipt from a second remote transmitter of an acquire bit thereof or one or more bits related to one or more control functions of the locomotive.

5. The system as set forth 4, wherein the slave controller is responsive to the one or more bits related to safety functions received from at least one of the first and second remote transmitters regardless of the states of the acquire bits thereof.

6. A remote locomotive control system comprising:

a first transmitter configured for radio transmitting a first data address and first acquire data;

a second transmitter configured for radio transmitting a second data address and second acquire data, the first and second transmitters also configured for radio transmitting control data regarding control functions of the locomotive and safety data related to safety functions of the locomotive; and a slave controller for radio receiving the data addresses, the acquire data, the control data and the safety data from the first and second transmitters, wherein the slave controller is responsive:

to safety control signals received from one or both of the first and second transmitters for controlling safety functions of the locomotive; and exclusively to the first acquire data received from the first transmitter for enabling the slave controller to control control functions of the locomotive as a function of the control data received from the first transmitter and to block control of control functions of the locomotive as a function of control data received from the second transmitter, wherein the slave controller includes:

a first receiver storing the first data address;

a second receiver storing the second data address;

a first image table coupled to receive first acquire data, control data and safety data from the first receiver; and a second image table coupled to receive second acquire data, control data and safety data from the second receiver, wherein:

the first receiver is responsive to the first data address for passing the first acquire data, the control data and the safety data received by the first receiver to the first image table; and the second receiver is responsive to the second data address for passing the second acquire data, the control data and the safety data received by the second receiver to the second image table.

7. The system of claim 6, wherein the slave controller is responsive:

exclusively to a change in the first acquire data received from the first transmitter for disabling the slave controller's control of the control functions of the locomotive as a function of control data received from the first transmitter; and exclusively to the second acquire data received from the second transmitter for enabling the slave controller to control control functions of the locomotive as a function of the control data received from the second transmitter and to block control of the control functions of the locomotive as a function of control data received from the first transmitter.

8. The system of claim 6, further including:

an OR'ed safety functions block coupled to receive and logically OR the safety data received from each image table and to pass said OR'ed safety data to a safety functions drivers block; and a steering logic block coupled to receive the acquire data and the control data from each image table and configured to (i) pass control data received from the first image table to a control function drivers block when the first acquire data is received by the steering logic block in the absence of the second acquire data being received thereby and (ii) pass control data received from the second image table to the control function drivers block when the second acquire data is received by the steering logic block in the absence of the first acquire data being received thereby.

9. The system of claim 8, wherein the steering logic block is configured:

to block the passage of control data received from the second image table when the second acquire data is received after receipt of the first acquire data; and to block the passage of control data received from the first image table when the first acquire data is received after receipt of the second acquire data.

10. The system of claim 8, wherein the steering logic block is configured:

to block the passage of control data from the first image table to the control function drivers block in response to a change in the first acquire data; and to block the passage of control data from the second image table to the control function drivers block in response to a change in the second acquire data.

11. The system of claim 6, wherein each transmitter includes:

operator controls for setting and changing the data address, the acquire data, the control data and the safety data transmitted thereby;

a data encoder for combining the data address, the acquire data, the control data and the safety data received thereby into a multi-bit data string; and a radio transmitter for modulating and radio transmitting the multi-bit data string to the slave controller.

12. The system of claim 11, wherein the slave controller includes first and second receivers, each receiver having:

a radio receiver operating at a unique frequency for receiving radio transmissions from one of the transmitters operating at the same unique frequency and for demodulating the multi-bit data string from each radio transmission; and a processing unit programmed with one of the data addresses, the processing unit comparing the data address included in the multi-bit data string to its programmed data address and passing the acquire data, the control data and the safety data of the multi-bit data string to one of the image tables for further processing when the data addresses match and blocking the passage of the acquire data, the control data and the safety data of the multi-bit data string to the one image table when the data addresses do not match.

* * * * *